United States Patent [19]

Lindquist et al.

[11] Patent Number: 4,766,639

[45] Date of Patent: Aug. 30, 1988

[54] BLOCKING DEVICE FOR A VACUUM CLEANER

[75] Inventors: Nils T. Lindquist, Farsta; Ann-Christine Hedin, Danderyd; Kurt O. Francke, Huddinge; Milos Vukotic, Skärholmen, all of Sweden

[73] Assignee: Aktiebolaget Electrolux, Sweden

[21] Appl. No.: 142,121

[22] Filed: Jan. 11, 1988

[30] Foreign Application Priority Data

Jan. 29, 1987 [SE] Sweden ..... 8700340

[51] Int. Cl.[4] ..... A47L 9/14

[52] U.S. Cl. ..... 15/339; 55/374; 55/DIG. 34

[58] Field of Search ..... 15/339, 319; 55/214, 55/274, DIG. 34

[56] References Cited

U.S. PATENT DOCUMENTS

| | | | |
|---|---|---|---|
| 2,322,948 | 6/1943 | Lofgren | 55/214 |
| 2,742,105 | 4/1956 | Dow | 55/214 |
| 4,001,912 | 1/1977 | Eriksson | 15/339 |
| 4,044,421 | 8/1977 | Kristenson et al. | 15/339 |

*Primary Examiner*—Chris K. Moore

*Attorney, Agent, or Firm*—Alfred E. Miller

[57] ABSTRACT

In a vacuum cleaner having a disposable dust bag of the kind comprising an attachment plate of cardboard or the like, and a cover adapted to be opened for the replacement of the dust bag, a blocking device is provided which is adapted to prevent closing of the cover when the dust bag is missing. The blocking device includes a slide actuated by a spring to be moved to a first position in which the closing of the cover is prevented, and a toggle-joint mechanism adapted to be actuated by the attachment plate to move the slide to a second position for permitting closing of the cover.

3 Claims, 1 Drawing Sheet

BLOCKING DEVICE FOR A VACUUM CLEANER

The present invention relates to a vacuum cleaner having a disposable dust bag of the kind comprising a rigid attachment plate of cardboard or the like surrounding the opening of the dust bag, said vacuum cleaner comprising a cover adapted to be opened for the replacement of the dust bag, and a blocking device adapted to prevent closing of the cover when the dust bag is missing.

Blocking devices of this kind are used to prevent the use of the vacuum cleaner without a dust bag in which case dust may enter the motor chamber and cause damage to the motor.

A device for this purpose is previously known from DE No. 2,902,630 which comprises a spring actuated means rotatable about an axis between a first position in which the closing of the cover is prevented, and a second position which is occupied when a dust bag has been inserted and which allows the closing of the cover and, consequently, the use of the vacuum cleaner. The disadvantage of a device of this kind is, however, that it is too bulky and consequently occupies too much space.

According to the present invention, a blocking device has been provided which requires only a minimum of space and which nevertheless has a good functional reliability. This has been achieved by means of a device of the kind mentioned in the introduction which according to the invention is characterized in that the blocking device comprises a slide actuated by a resilient force to be moved to a position in which the closing of the cover is prevented, and a toggle-joint mechanism adapted to be actuated by said dust bag attachment plate to move the slide to another position for permitting closing of the cover.

Figure 1:
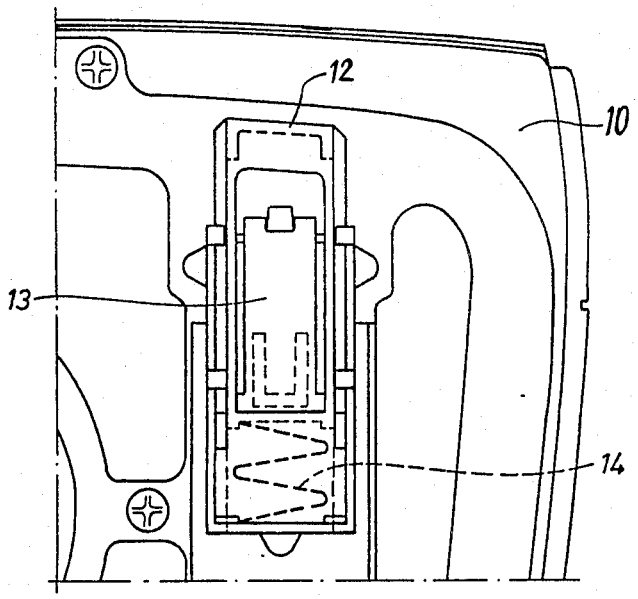
Figure 2:
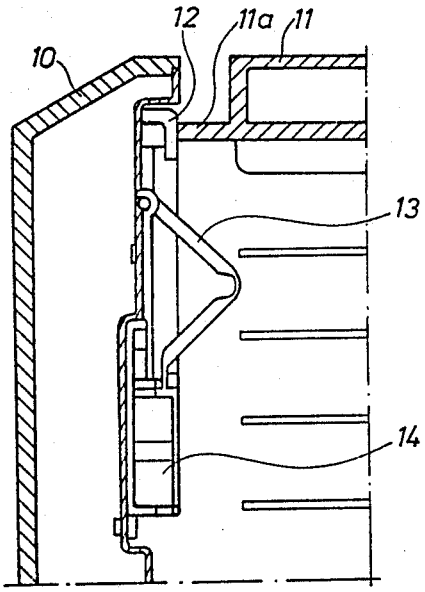
Figure 3:
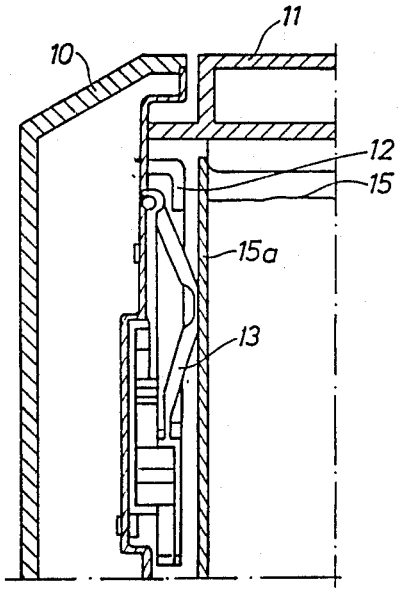

The invention will be described in more detail below with reference to the accompanying drawing on which FIG. 1 illustrates a front elevational view of the blocking device according to the invention, FIG. 2 is a side sectional view, and FIG. 3 is a view corresponding to FIG. 2 but showing the device in another position.

The drawing illustrates a partially shown cover 10 hinged to a vacuum cleaner housing 11 which is also shown partially. The blocking device is attached to the inside of the cover 10 and comprises a vertically movable slide 12 which is actuatable by a toggle-joint mechanism 13, the two opposite ends of which are hingedly connected to the cover 10 and the slide 12, respectively. The slide 12 is actuated by a spring 14 and biased to its upper end position as seen in FIGS. 1 and 2.

In the position shown in FIG. 2 no dust bag has been inserted into the cleaner, and the closing of the cover 10 is prevented by the upper end of the slide 12 which engages the edge portion 11*a* of the vacuum cleaner housing. The vacuum cleaner can therefore not be used.

In FIG. 3, the vacuum cleaner is provided with a dust bag 15 having an attachment plate 15*a*. When the cover 10 is closed, the toggle-joint mechanism 13 engages the attachment plate 15*a* whereby the slide 12 and particularly its upper end is moved to a lower position against the force of the spring 14, as is shown in the Figure. The cover 10 can therefore be closed without being obstructed by the upper end of slide 12.

We claim:

1. A vacuum cleaner, having a dust bag of the type provided with a rigid attachment plate, comprising: an openable cover for replacement of said dust bag, a blocking device for preventing the closing of said cover when a dust bag is missing in the vacuum cleaner, said blocking device including a slide, a resilient member biasing said slide to a first position within said vacuum cleaner whereby closing of said cover is prevented when the dust bag is missing in said vacuum cleaner, and a toggle joint mechanism actuated by said attachment plate to move said slide to a second position whereby the closing of said cover is permitted.

2. A vacuum cleaner as claimed in claim 1 wherein said resilient member is a spring.

3. A vacuum cleaner as claimed in claim 1 wherein said toggle joint mechanism includes two links which are pivotally interconnected, and in which one link is hinged to a stationary axis and the other link is hinged to said slide.

* * * * *